US009685750B2

(12) United States Patent
Cachia

(10) Patent No.: US 9,685,750 B2
(45) Date of Patent: Jun. 20, 2017

(54) METHOD FOR ASSISTING ALIGNMENT OF A PIN HEADER

(71) Applicant: Control Techniques Limited, Newtown (GB)

(72) Inventor: Charles Anthony Cachia, Welshpool (GB)

(73) Assignee: NIDEC CONTROL TECHNIQUES LIMITED, Newtown (GB)

( * ) Notice: Subject to any disclaimer, the term of this patent is extended or adjusted under 35 U.S.C. 154(b) by 454 days.

(21) Appl. No.: 14/168,430

(22) Filed: Jan. 30, 2014

(65) Prior Publication Data

US 2014/0208589 A1 Jul. 31, 2014

(30) Foreign Application Priority Data

Jan. 30, 2013 (GB) ..... 1301649.8

(51) Int. Cl.
*H01R 43/20* (2006.01)
*H01R 43/02* (2006.01)

(52) U.S. Cl.
CPC ..... *H01R 43/205* (2013.01); *H01R 43/0256* (2013.01); *H01R 43/0263* (2013.01); *Y10T 29/49147* (2015.01); *Y10T 29/53209* (2015.01)

(58) Field of Classification Search
CPC ..... H01R 3/301; H01R 3/32; H01R 3/325; H01R 31/06; H01R 31/066; H01R 43/0256; H01R 43/0263; H01R 43/205; Y10T 29/49147; Y10T 29/53209
See application file for complete search history.

(56) References Cited

U.S. PATENT DOCUMENTS

| | | | | |
|---|---|---|---|---|
| 4,739,550 | A | 4/1988 | Schaeffer et al. | |
| 6,047,875 | A | 4/2000 | Al-Nabulsi | |
| 6,241,141 | B1 | 6/2001 | Al-Nabulsi | |
| 6,460,755 | B1 * | 10/2002 | Inoue | B23K 3/0623 228/180.22 |
| 6,540,562 | B1 * | 4/2003 | Baker | H01R 24/78 439/668 |
| 2011/0117757 | A1 * | 5/2011 | Seibold | H05K 1/141 439/83 |

FOREIGN PATENT DOCUMENTS

| | | |
|---|---|---|
| GB | 1220647 | 1/1971 |
| JP | 7-302655 | 11/1995 |
| WO | 2007/090691 | * 8/2007 |

* cited by examiner

*Primary Examiner* — Carl Arbes
(74) *Attorney, Agent, or Firm* — Harness, Dickey & Pierce, P.L.C.

(57) ABSTRACT

The present invention relates to a method and tool for assisting alignment of one or more pin headers. In particular, the invention relates to a tool-assisted method of aiding alignment of one or more pin headers placed on a printed circuit board (PCB) prior to soldering, as well as to the tool itself.

14 Claims, 8 Drawing Sheets

METHOD FOR ASSISTING ALIGNMENT OF A PIN HEADER

CROSS-REFERENCE TO RELATED APPLICATION

This application claims the benefit and priority of Great Britain Patent Application No. 1301649.8 filed Jan. 30, 2013. The entire disclosure of the above referenced application is incorporated herein by reference.

FIELD

The present invention relates to a method and tool for assisting alignment of one or more pin headers. In particular, the invention relates to a tool-assisted method of aiding alignment of one or more pin headers placed on a printed circuit board (PCB) prior to soldering, as well as to the tool itself.

BACKGROUND

Pin headers are electrical connectors typically used with a mating socket. They are often used to interface between the control and power sides of electrical products. They can also be used to connect two PCBs. As with other electrical components, pin headers must typically be soldered to a PCB. For large-scale soldering, wave soldering is usually employed. Prior to wave soldering, electrical components are positioned in their designated locations on the PCB before the PCB is placed on the surface of a bath of molten solder. Waves of solder are then washed over the underside of the PCB, forming electrical connections where desired. A similar mass-scale soldering process, known as reflow soldering, can also be used for surface mount components. Reflow soldering uses solder paste to temporarily fix the components in place, before the paste is melted to form a final electrical connection.

Misalignment of pin headers prior to soldering is a common problem. Due in part to the pin header's own weight, misalignment can occur prior to the PCB entering the solder bath or even during soldering. Misaligned pin headers lead to faulty connections, which can lead to defective products. Correcting misalignment is time-consuming and increases overall production costs.

One example of a known device used to assist alignment of pin headers prior to soldering includes the apparatus shown in JP7302655A. The pins of the pin header are held in place by a device 3 (see FIG. 1). Device 3 is inserted or soldered into the PCB (see FIG. 2).

There is nonetheless a need in the art for an improved tool that reliably and efficiently allows for assisted alignment of pin headers prior to soldering. The present invention seeks to address this and other problems encountered in the art.

SUMMARY

In accordance with a first aspect of the present invention, there is provided a method of assisting alignment of a pin header prior to soldering, the pin header comprising pins supported by a collar. The method comprises placing the pin header on a printed circuit board (PCB) such that the pins on a first side of the collar engage the surface of the PCB, and such that the collar contacts the surface of the PCB. The method further comprises positioning in contact with the pins on the first side of the collar a removable tool so as to exert a force on the pins on the first side of the collar, thereby causing the collar to urge the pins on a second side of the collar into a soldering position.

Any number of pins may be held by the collar. The collar, or yoke, may be open-ended or closed. The position of the collar may divide the pins into two sections or pin portions, one on either side of the collar. When reference is made to pins on one side of the collar and pins on another side of the collar, reference is made to the same pins, as the pins generally pass through the collar. Furthermore, for the sake of clarity, in what follows, pin portions may be referred to simply as pins, and the two are used interchangeably. The tool may be used with a pin header having a single row of pins, or with a pin header having more than two rows of pins. In either case, the tool may act on the top row of pins.

Preferably, on the first side of the collar, the pins are bent at a right angle as with right-angled pin headers. By positioning the tool in contact with the pin portions on the first side of the collar, the pins on the second side of the collar may be urged, or biased, into their soldering position. The tool is preferably made of aluminium, although other types of material may be used. Preferably, the tool is made from a material that is easy to machine, tolerant to high temperatures, and relatively inexpensive. Preferably, the material should also produce a smooth finish when machined so that pick-and-place machines may more easily pick up and handle the tool. The density may also be an important factor in determining the material of the tool. If a very heavy material is used, the tool may be too unwieldy for the pick-and-place machine. A material with a higher density such as brass may be used, though brass is generally more expensive than aluminium. Another example of an alternative material is Durastone. Durastone, though tending to be expensive, is a relatively rigid man-made material which is generally easy to machine and can withstand the high temperatures of wave and reflow soldering.

The soldering position may be any position in which the pin header is suitable for being soldered to the PCB, and such that fewer alignment problems will arise with the pins during assembly of the product. When in the correct soldering position, the pins on the second side of the collar are preferably brought into parallel alignment with the PCB. In some embodiments, alignment of the pins on the second side of the collar may be achieved without needing the pins to be substantially parallel to the PCB. The pins on the second side of the tool may be urged into a position such that at least some of the pins contact the underside of the tool. The tool is advantageously easily removable from the pin header, in that it may be freely positioned on top of, and removed from, one or more pin headers.

Advantageously, after use, the tool can be recycled and reused, or simply disposed of, as it does not need to be fixedly attached to the PCB or the pin header. Thus, the tool offers a simple and economic means of assisting alignment of one or more pin headers. Because the pin header is held in the correct position prior to soldering, fewer alignment problems are experienced further down the assembly of the product. The tool improves the yield at wave/reflow soldering, and helps to reduce the number of bent and damaged pins. The tool can be used with both wave soldering and reflow soldering methods.

The positioning step may comprise removably positioning the tool in contact with the pins of multiple pin headers placed on the PCB, thereby assisting alignment of the multiple pin headers simultaneously. Thus, the tool may be shaped and sized to assist alignment of multiple pin headers. For example, the tool may be suited to rest on a pair of pin headers, and in doing so the pin headers provide the tool with stability. Advantageously, a tool for assisting alignment of a single pin header is less heavy and therefore may be more easily handled and properly positioned by pick-and-place machines.

The tool may comprise a supporting element removably engageable with the PCB, and the method may further comprise engaging the supporting element with the PCB. The supporting element may be particularly suited for a tool designed to assist alignment of a single pin header, as in such a case the single pin header offers less stability to the tool than in the case of two or more pin headers. The supporting element may removably engage with the PCB using any conventional means, and preferably prevents the tool from shifting laterally, that is in a direction perpendicular to the pins.

The tool may comprise a biasing portion joined to the supporting element, and the positioning step may comprise removably positioning the biasing portion in contact with the pins of the pin header. The biasing portion may be substantially rectangular in shape, and may be joined to the supporting element at a right angle. When the supporting element is engaged with the PCB, the tool may be free to pivot or rotate about a fulcrum, and thereby exert a biasing force on the pins of the pin header.

The supporting element may be arranged to stabilise the tool when the tool is positioned in contact with the pins of the pin header. Whilst the tool could be used without a supporting element, the supporting element may prevent the tool from shifting, especially during the soldering process, which could otherwise lead to alignment issues with the pin header.

The supporting element may comprise members for interlocking/engaging with corresponding apertures in the PCB. The members, or feet, may be shaped in conformity with corresponding slots in the PCB. Preferably, however, the engagement of the members with the PCB should not be such as to prevent the tool from tending to rotate about the fulcrum described above.

The collar may contact the surface of the PCB at a fulcrum point, and the positioning step may comprise removably positioning the tool in contact with the pins on the first side of the collar, thereby urging the pins on the second side of the collar into the soldering position by causing the collar to rotate about the fulcrum point. Thus, in a first, pre-alignment position, the pins on the second side of the collar may contact the PCB. By then positioning the tool such that it contacts the pins on the first side of the collar, a substantially axial force may be exerted by the tool along the length of the pins on the first side of the collar. This force may cause the collar to rotate about its point of contact with the PCB, lifting the pins on the second side of the collar off the PCB and into their soldering positions.

The tool may comprise one or more recessed portions, and the method may further comprise receiving the collar of the pin header in a recessed portion during positioning of the tool. The recessed portions may be sized and shaped substantially in conformity with the collar of the pin header. Multiple recesses may be used if the tool is arranged to assist alignment of multiple pin headers.

The one or more recessed portions may be each sized such that, when receiving the collar of the pin header, a clearance is maintained between the collar and the tool. Advantageously, during positioning, the tool does not contact the collar. Any such contact could prevent the collar from rotating and thereby prevent correct alignment of the pin header, and in particular the pins on the second side of the collar. Thus, in the present invention, the tool may be arranged to contact only the pins of the pin header during alignment.

Each recessed portion is preferably elongate and rectangular in shape. Preferably, the ends of each recessed portion are flat. This may allow for a flat surface against which the collar of the pin header may make contact should the tool move laterally with respect to the pin header. The ends of the recessed portion may thus effectively act as stops. Alternatively, each recessed portion may comprise an enlarged, rounded recessed portion at each end, such that the recessed portion as a whole may resemble a dog-bone. Such enlarged ends preferably comprise a flat portion against which the collar may make contact. These enlarged ends may provide clearance for the ends of the collar and may also create a flat surface against which the collar may make contact. Such enlarged ends are particularly advantageous for a tool designed to assist alignment of more than one pin header, as such a tool generally does not comprise a supporting element and may therefore move more freely along the width of the pin header (e.g. in a direction perpendicular to the pins). In contrast, a tool designed for a single pin header generally comprises a supporting element that may fit into slots of the PCB and thereby prevent lateral movement of the tool, and thus having a recess with enlarged, rounded ends is not particularly desirable or necessary.

The enlarged ends may prevent the collar from catching and interfering with the ends of a recess, as would be the case if the ends of the recessed portion were not enlarged, but if they instead resembled a cylinder with outwardly-bulging hemispheres at either end (e.g. were hotdog-shaped). As the tool is preferably machined (typically using a milling machine) from a solid block using a round cutter, the enlarged end portions (dog-bone like features) are useful. Of course, a recessed portion with flat ends may be machined, for example using spark erosion. However, spark erosion is a generally much more expensive process than cutting.

The tool may be weighted so as to prevent the pins on the second side of the collar from tending away from the soldering position when the tool is positioned in contact with the pins on the first side of the collar, by exerting an axial force along the pins on the first side of the collar and in a direction of the PCB. In particular, the tool may be weighted substantially towards a portion of the tool that comes into contact with the pins on the first side of the collar. This may be particularly true in cases where the tool does not comprise a supporting element (and thus does not come into contact with the PCB) such as when the tool is for assisting alignment of a single pin header, as in this case the tool does not benefit from the added effect of the rotation about the fulcrum point.

The centre of gravity of the pin header may cause the pins on the second side of the collar to tend away from the soldering position, and the centre of gravity of the tool may thus be used to counterbalance the centre of gravity of the pin header during the positioning step, thereby preventing the pins on the second side of the collar from tending away from the soldering position The tool may further comprise apertures for allowing a pick-and-place machine to locate the tool. There may be any number and shape of apertures disposed in the tool. In other embodiments, the apertures could be replaced with other features that allow the pick-and-place machines to locate the tool. The apertures may assist the pick-and-place machine to accurately locate the tool. The pick-and-place machine may therefore use the hole as references. Different machines may require different quantities of apertures as references, and some may not require any apertures depending on the technology used by the machine. Preferably, the tool comprises a smooth upper surface to facilitate the pick-and-place machine in picking up the tool. Such machines usually employ rubber suckers that operate by a partial vacuum.

In accordance with a second aspect of the invention, there is provided a tool for assisting alignment of a pin header placed on a printed circuit board (PCB) prior to soldering. The pin header comprises pins supported by a collar in contact with a surface of the PCB. The pins on a first side of the collar engage the surface of the PCB, and the tool is arranged to be removably positioned in contact with the pins on the first side of the collar so as to exert a force on the pins, thereby causing the collar to urge the pins on a second side of the collar into a soldering position.

The tool may be further arranged to be removably positioned in contact with the pins of multiple pin headers placed on the PCB, thereby assisting alignment of the multiple pin headers simultaneously.

The tool may comprise a supporting element removably engageable with the PCB. The tool may comprise a biasing portion joined to the supporting element, and the biasing element may be arranged to be removably positioned in contact with the pins of the pin header.

The supporting element may be arranged to stabilise the tool when the tool is positioned in contact with the pins of the pin header.

The supporting element may comprise members for engaging with corresponding apertures in the PCB.

The collar may contact the surface of the PCB at a fulcrum point, and the tool may be further arranged such that, when positioned in contact with the pins on the first side of the collar, the tool may urge the pins on the second side of the collar into the soldering position by causing the collar to rotate about the fulcrum point.

The tool may comprise one or more recessed portions for receiving the collar of the pin header during positioning of the tool. The one or more recessed portions may each be sized such that, when receiving the collar of the pin header, a clearance is maintained between the collar and the tool.

The one or more recessed portions may each comprise substantially flat ends.

The one or more recessed portions may be substantially rectangular and each may comprise at least one rounded end that is wider than the recessed portion. Each rounded end may comprise a flat portion. The flat portion may be substantially perpendicular to the major axis of the rectangular recessed portion.

The tool may be weighted so as to prevent the pins on the second side of the collar from tending away from the soldering position when the tool is positioned in contact with the pins on the first side of the collar, by exerting an axial force along the pins on the first side of the collar and in a direction of the PCB.

The centre of gravity of the pin header may cause the pins on the second side of the collar to tend away from the soldering position, and the tool may be further arranged such that its centre of gravity counterbalances the centre of gravity of the pin header when the tool is positioned in contact with the pins on the first side of the collar, thereby preventing the pins on the second side of the collar from tending away from the soldering position.

In the soldering position, the pins on the second side of the collar may be substantially parallel to the surface of the PCB.

The tool may further comprise apertures for allowing a pick-and-place machine to locate the tool.

The tool may further comprise a smooth upper surface for allowing a pick-and-place machine to pick up or otherwise handle the tool.

BRIEF DESCRIPTION OF THE DRAWINGS

Preferred embodiments of the invention will now be described in connection with the drawings, in which.

DETAILED DESCRIPTION OF PREFERRED EMBODIMENTS

The present invention seeks to provide an improved tool for assisting alignment of one or more pin headers prior to soldering. Whilst various embodiments of the invention are described below, the invention is not limited to these embodiments, and variations of these embodiments may well fall within the scope of the invention which is to be limited only by the appended claims.

Figure 1:
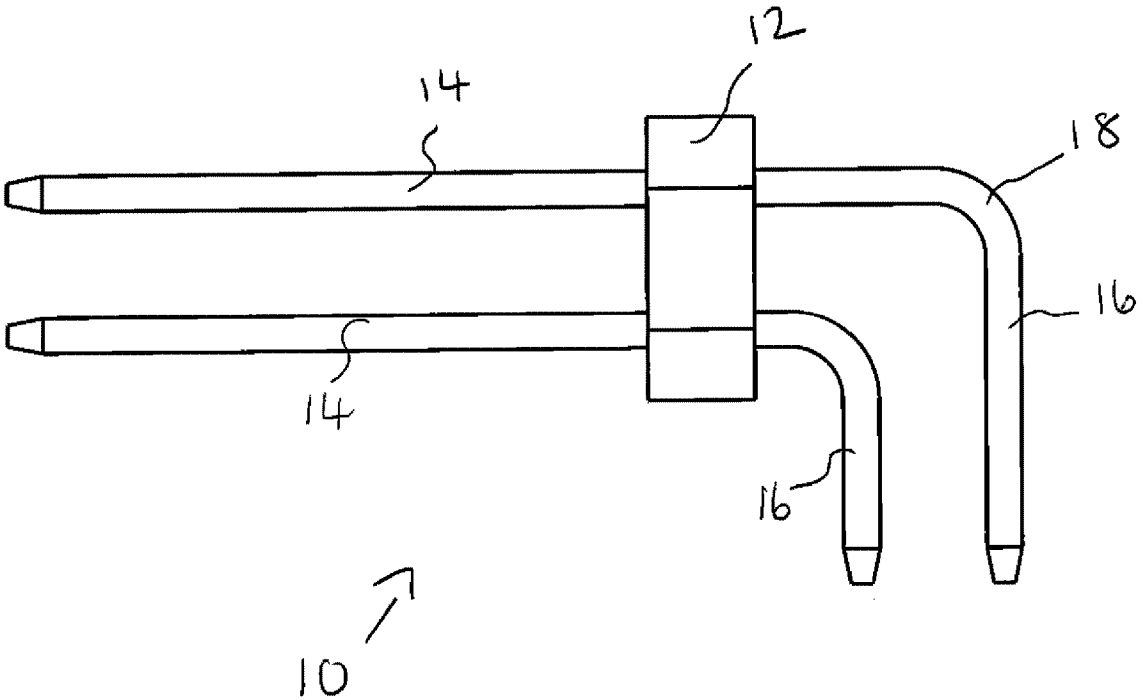
FIG. 1 is a side-on view of a typical right-angled pin header.

FIG. 1 shows a typical right-angled pin header 10. Pin header 10 comprises a yoke or collar 12 supporting a plurality of conductive pins. Pins are divided by collar 12 into a section of substantially straight pins portions 14 and a section of right-angled pins portions 16. In the present embodiment, only two pins are visible, each comprising a straight pin portion and a right-angled pin portion. However, as known to a person skilled in the art, pin header 10 may comprise any number of pins and in particular collar 12 is arranged to support two rows or banks of pins (as seen for example in FIG. 5), with pin portions 14 forming two parallel pin rows, and pin portions 16 forming two rows of right-angled pins shaped in conformity with one another. In other embodiments, there may be other types of pin configurations. For example, the pin header may have only one row of pins, or may have more than two rows of pins. Each pin portion 16 comprises a right-angle-bend 18. Collar 12 is typically formed of plastic but other suitable materials may be used. For the sake of clarity, in what follows, pin portions may be referred to simply as pins, and the two are used interchangeably.

Figure 2:
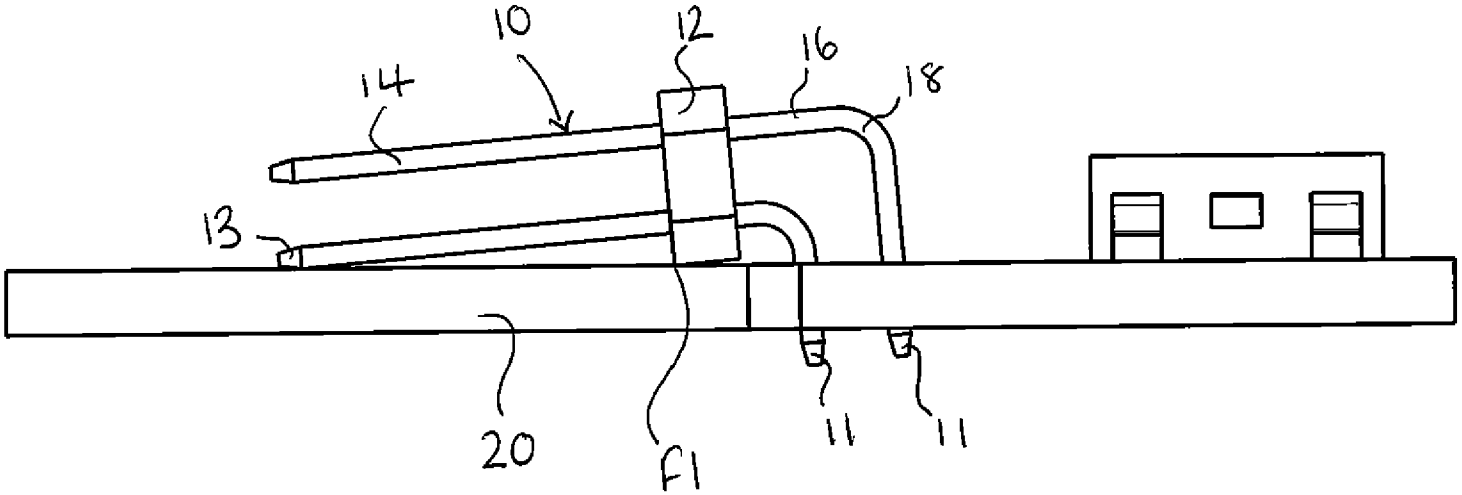
FIG. 2 is a side-on view of a pin header placed on a PCB prior to soldering.

FIG. 2 shows pin header 10 positioned on a PCB 20 prior to soldering. The ends 11 of one row of pins 16 are placed into PCB 20 to anchor pin header 10 in position. Whilst pins 16 are seen to be inserted within PCB 20, it shall be appreciated that in other embodiments pins 16 may merely rest on PCB 20. Collar 12 engages or otherwise contacts PCB 20 at contact point or fulcrum F1. Because of the weight of pin header 10, the ends 13 of the lower bank of pins 14 rest on PCB 20.

It is desirable, prior to soldering, that pins 16 be raised away from PCB 20 such that pins 16 may be maintained substantially parallel to the surface of PCB 20. This may assist correct alignment of the pins of pin header 10, resulting in more precise and less wasteful soldering.

Figure 3:
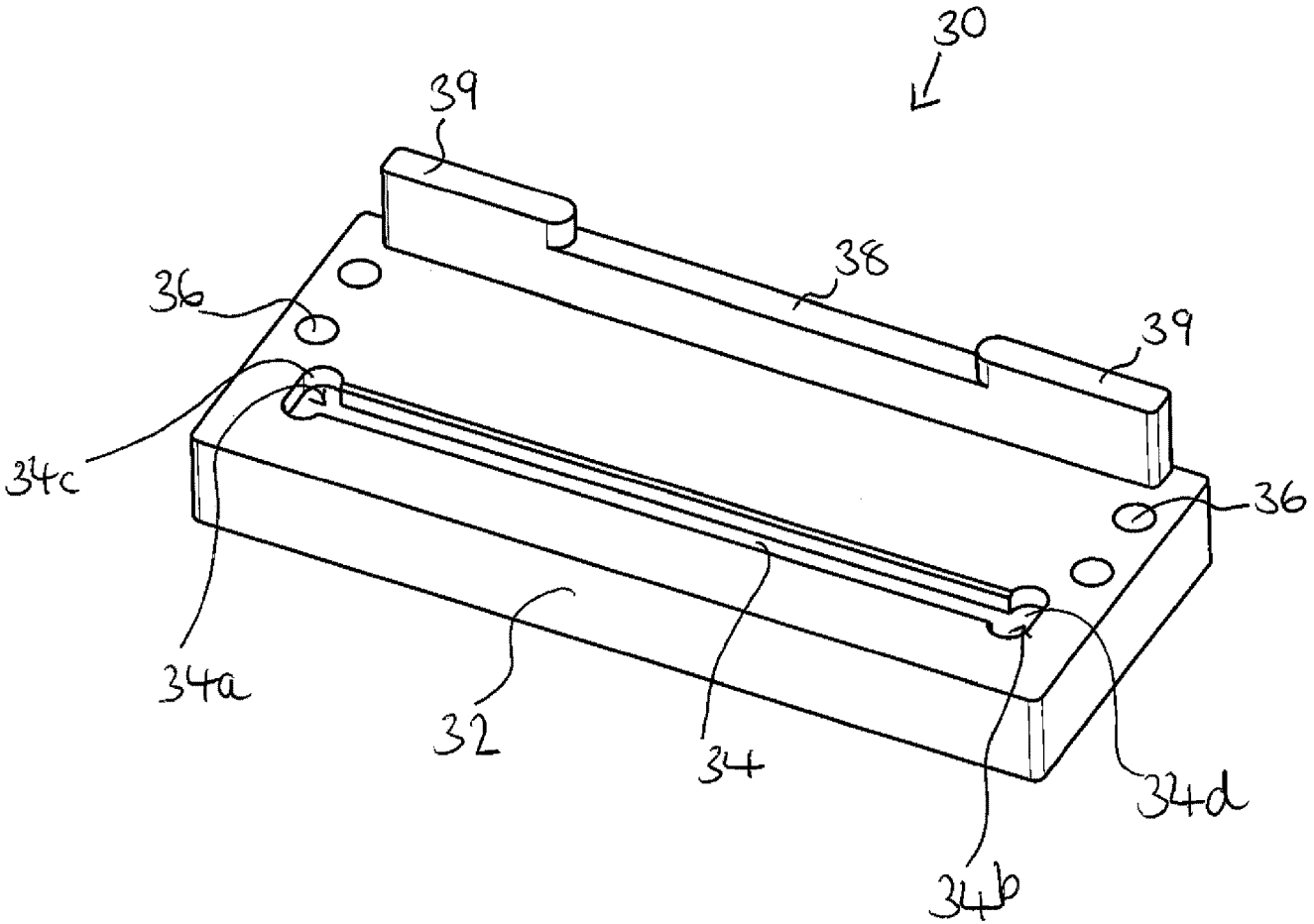
FIG. 3 is a perspective view of a tool in accordance with a first embodiment of the invention.

FIG. 3 shows a preferred embodiment of a tool 30 in accordance with the present invention. The underside of tool 30 is shown in FIG. 3. Tool 30 comprises a substantially rectangular biasing portion 32, a recessed portion 34, apertures 36 and a supporting element 38.

Supporting element 38 is joined to and at one end of biasing portion 32 at a right angle. Supporting element 38 comprises a pair of engaging members or feet 39 disposed at both ends of supporting element 38. Recessed portion 34 is substantially elongate and rectangular in shape, and is sized so as to receive therein a typical collar or yoke of a pin header. Rounded end portions 34*a* and 34*b* are disposed at the ends of recessed portion 34, with each rounded end portion 34*a*, 34*b* comprising a flat portion 34*c*, 34*d* against which a collar of a pin header may make contact. Apertures 36 are positioned around the periphery of tool 30, and are used for SMT component placement systems (otherwise known in the art as pick-and-place machines) to locate tool 30 prior to and after positioning. Four apertures 36 are shown in FIG. 3, although the number, placement and dimensions of the apertures may vary depending on many factors, such as the size of tool, its, weight, etc.

Figure 4:
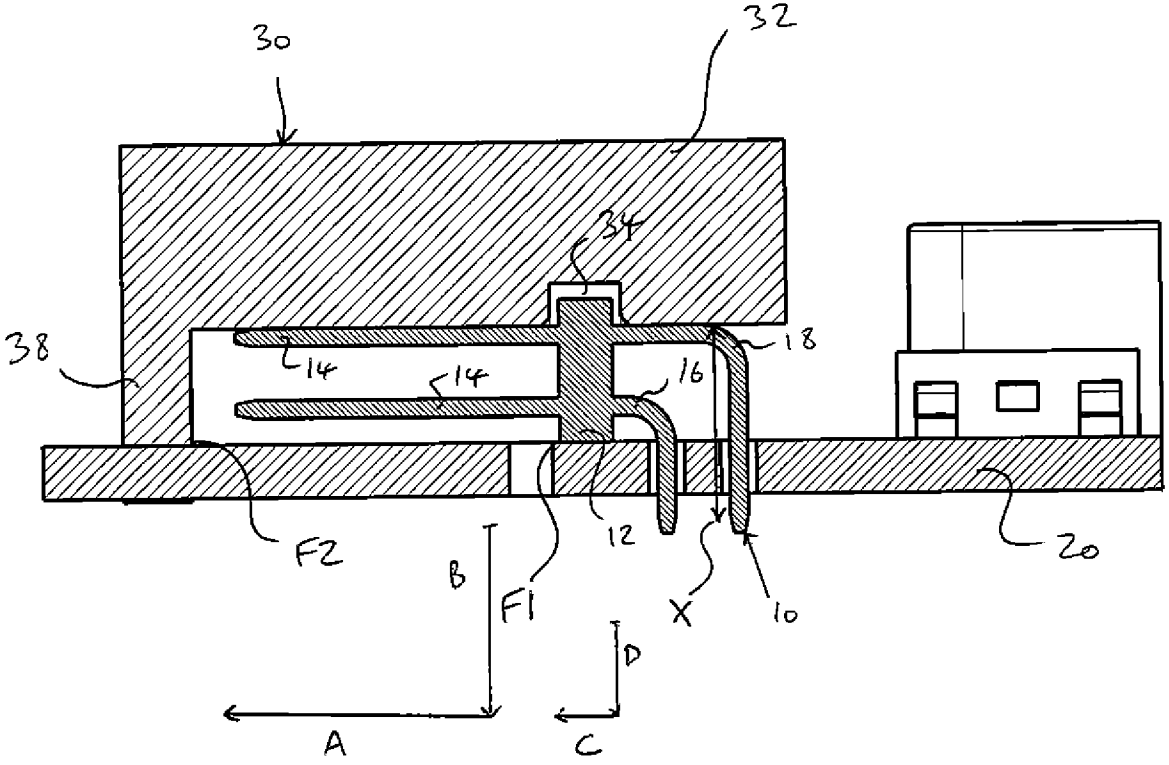
FIG. 4 is a cross-sectional view of the tool of FIG. 3 in use with the pin header of FIG. 2.
Figure 5:
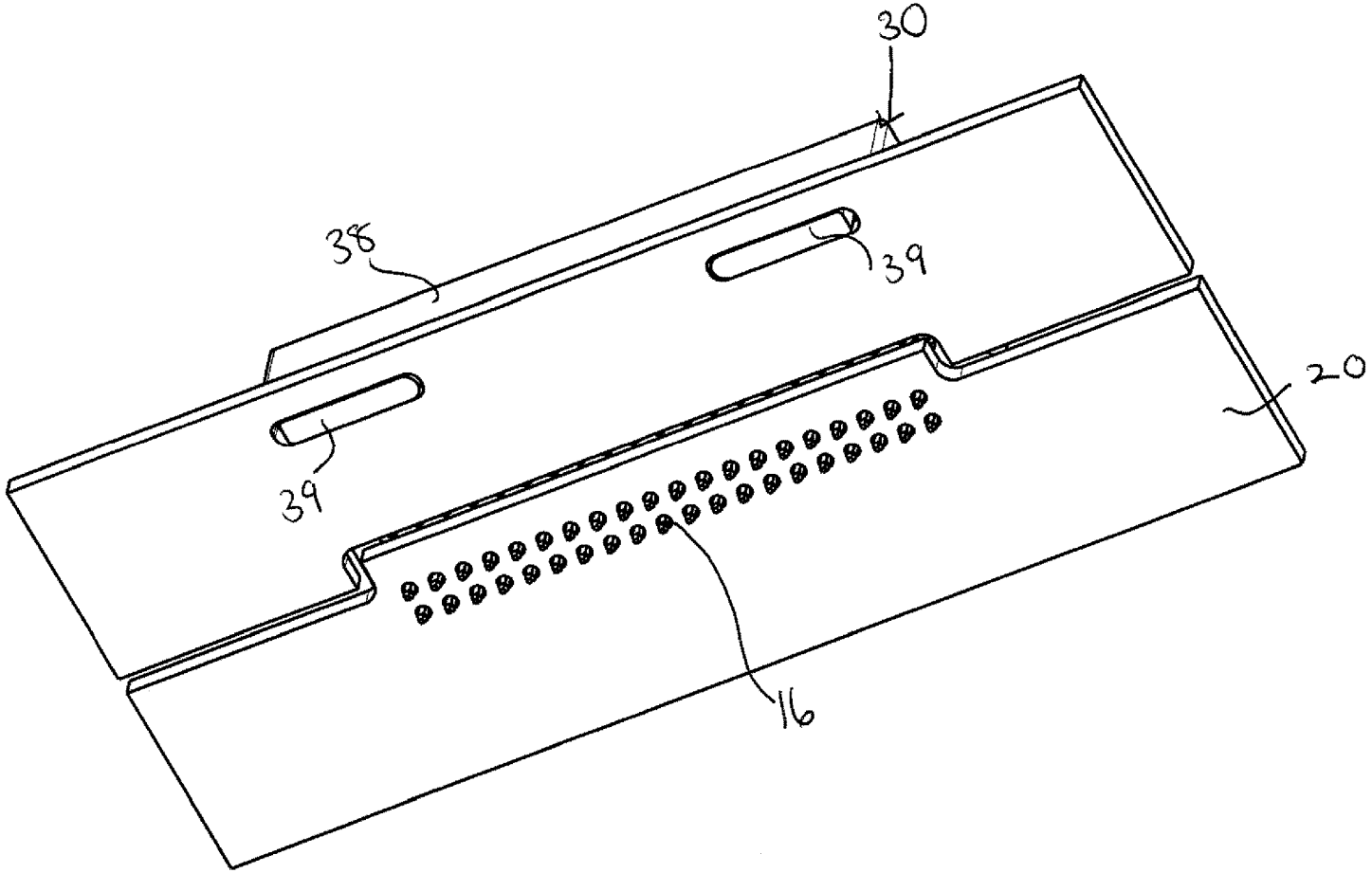
FIG. 5 is a perspective view of the underside of the tool of FIG. 3, engaged with the PCB.

Prior to soldering (such as wave soldering, as known in the art), tool 30 is positioned in contact with pin header 10 as shown in FIG. 4. Engaging feet 39 of supporting element 38 are removably slotted or inserted into corresponding apertures in PCB 20, providing support for tool 30. Feet 39 are preferably not engaged in PCB 20 so as to lock tool 30 with PCB 20. Rather, tool 30 is substantially free to pivot or rotate about contact point or fulcrum F2 in a clockwise direction. FIG. 5 shows the underside of PCB 20, with feet 39 of supporting element 38 engaged in slots of PCB 20. Returning to FIG. 4, the forward end of biasing portion 32 contacts pins 16 substantially near right-angled bend 18 of pins 16, thereby exerting a downward, axial force along pins 16 in a direction of PCB 20. In doing so, pin portions 16 act on collar 12 which is rotated or pivoted about fulcrum F1 in a clockwise direction, bringing pin portions 14 into a suitable soldering position. Pin portions 14 in FIG. 4 are shown to be aligned in a substantially parallel direction relative to the surface of PCB 20. In other embodiments, it is envisaged that other suitable soldering positions may exist.

Recessed portion 34 advantageously provides clearance for collar 12 as tool 30 is brought into contact with pin header 10. As illustrated by lines AB and CD, the centre of gravity of tool 30, when tool 30 is positioned in contact with pin header 10, is such as to counterbalance the centre of gravity of pin header 10. In particular, for pin header 10 to be kept in a soldering position, AB must be greater than CD, with: A being the distance from fulcrum point F2 to the centre of gravity of tool 30; B being the weight of tool 30; C being the distance from fulcrum point F1 to the centre of gravity of pin header 10; and D being the weight of pin header 10. Tool 30 initially makes contact with pin header generally along line X. As this line does not lie in the same position as the centre of gravity of tool 30, it is not the total weight of tool 30 that acts on the point of contact with pin portions 16.

Figure 6:
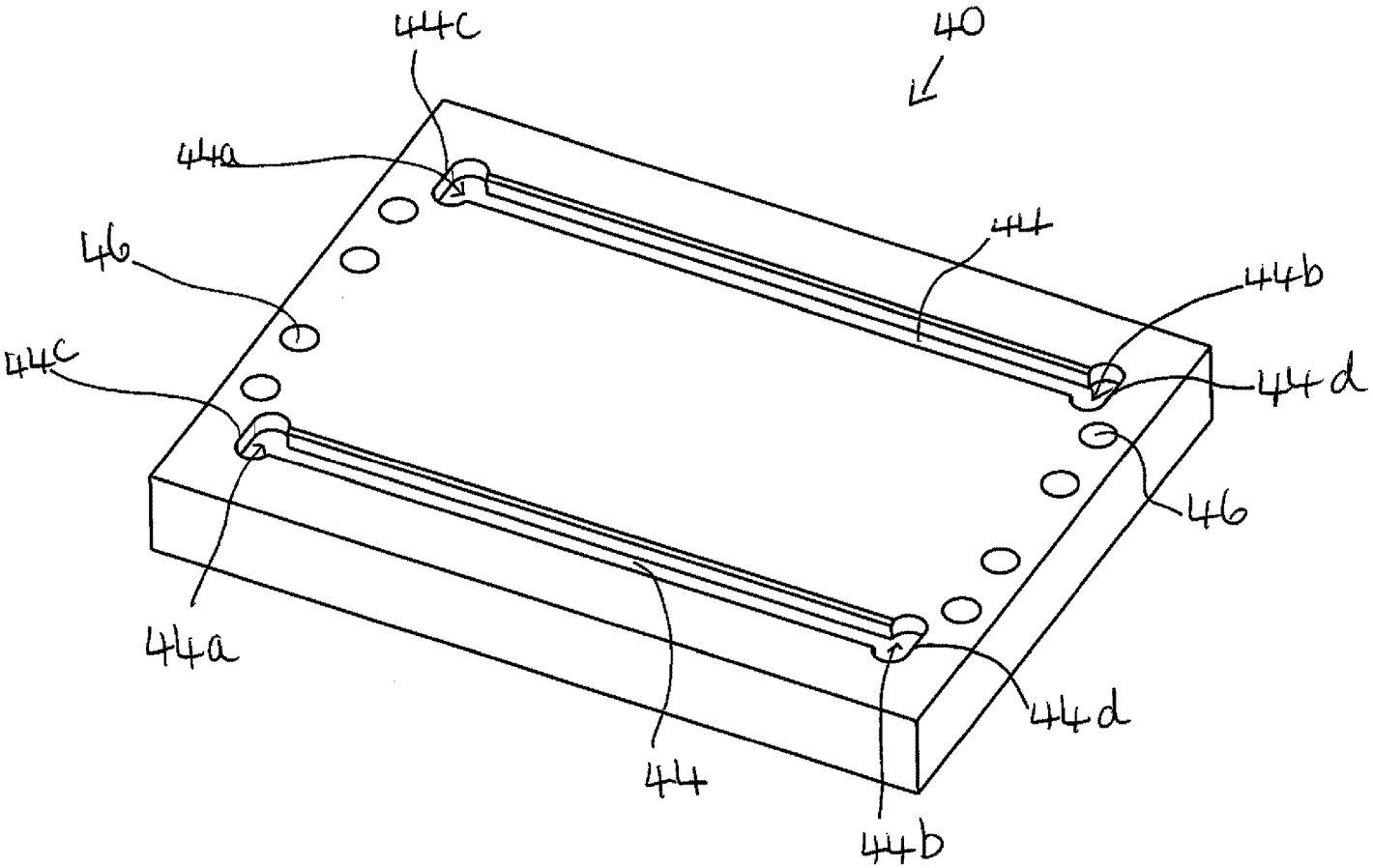
FIG. 6 is a perspective view of a tool in accordance with a second embodiment of the invention.

In an alternative embodiment of the present invention, FIG. 6 shows a possible second version of the tool. Tool 40 is similar to tool 30 in that it also comprises apertures 46 for a pick-and-place machine, and further includes two elongate recesses 44 sized and shaped to receive collars of pin headers. Recesses 44 comprise rounded end portions 44*a* and 44*c*, with each rounded end or rounded end portion comprising a substantially flat portion 44*b*, 44*d*. Of note is that tool 40 does not comprise a supporting element. Thus, as explained above, rounded end portions 44*a*, 44*c* and flat portions 44*b*, 44*d* are advantageous in preventing a pin header collar from interfering with tool 40 should tool 40 shift laterally before or during soldering. In other embodiments, the tool of FIG. 6 could comprise one or more supporting elements.

Figure 7:
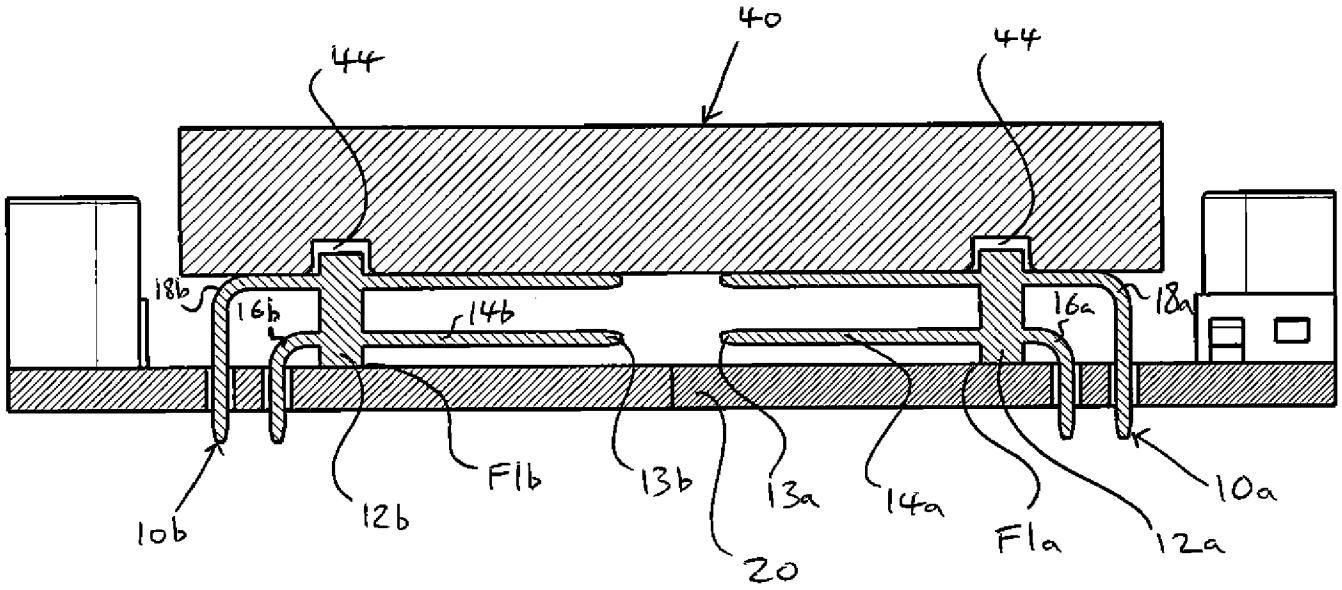
FIG. 7 is a cross-sectional view of the tool of FIG. 6 in use with two pin headers placed on a PCB.

Tool 40 is suited to assist in the alignment of multiple pin headers simultaneously. As shown in FIG. 7, tool 40 is positioned in contact with pins 16*a* and 16*b* of a pair of pin headers 10*a* and 10*b*. Prior to tool 40 being positioned in contact with pin headers 10*a*, 10*b*, pin headers 10*a*, 10*b*, were first placed in pre-soldering positions on PCB 20 much like pin header 10 illustrated in FIG. 2. In such a position, ends 13*a* and 13*b* of pins 10*a*, 10*b* tended towards non-parallel alignment relative to the surface of PCB 20. As explained above in relation to FIG. 4, tool 40 exerts a downwards pressure or force on pin portions 16*a* and 16*b*, proximal right-angle bends 18*a* and 18*b*. This force may translate into a force on collars 12*a* and 12*b*, thereby causing collars 12*a*, 12*b*, to rotate or pivot about fulcrum points F1*a* and F1*b* in respective clockwise and counter-clockwise directions, bringing pin portions 14*a* and 14*b* into soldering positions, preferably in parallel alignment with PCB 20. Due to the added support provided by dual pin headers, supporting elements generally are not required on tools such as tool 40.

Figure 9:
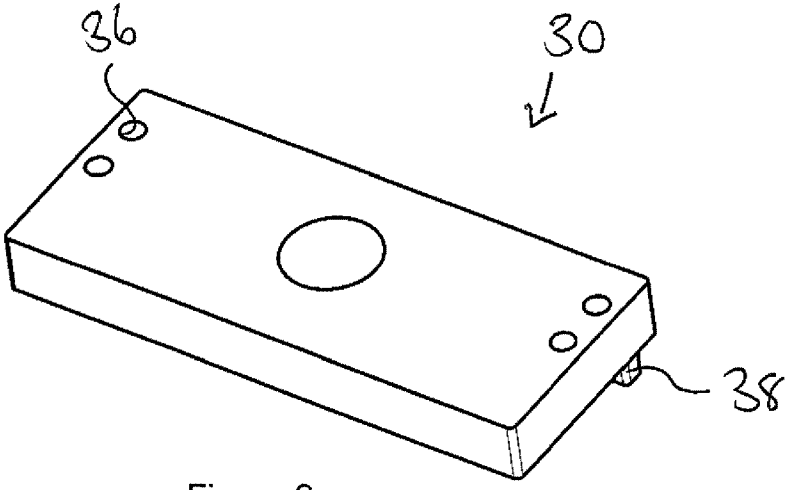
FIG. 9 is a third perspective view of the tool of FIG. 3.
Figure 8:
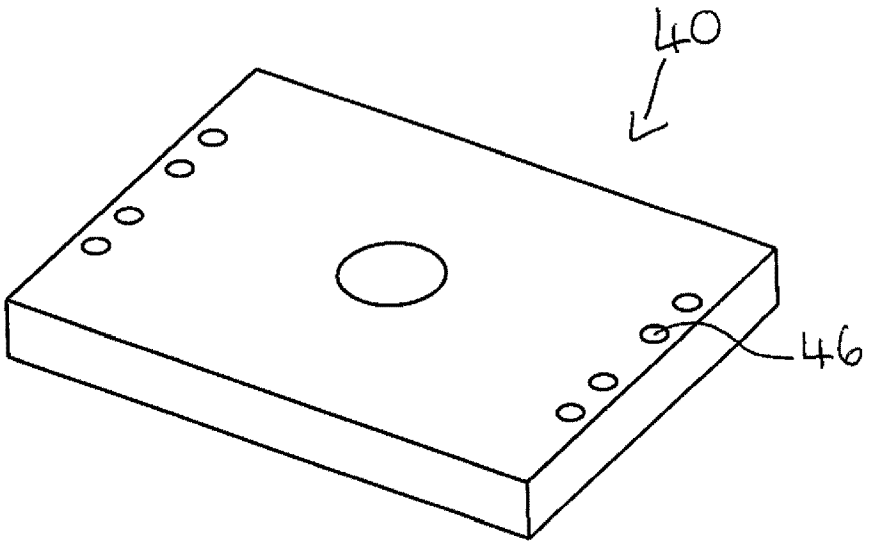
FIG. 8 is a second perspective view of the tool of FIG. 6.

FIGS. 8 and 9 show the upper sides of tools 40 and 30, respectively. The circles show the locations of action of pick-and-place machines. The surfaces of tools 30 and 40 must preferably be smooth enough for the suction action of the machine to operate efficiently.

Any feature of the above-described embodiments may be combined with the features of another embodiment, by making the appropriate changes. Whilst the invention has been described in connection with preferred embodiments, it is to be understood that the invention is not limited to these embodiments, and that alterations, modifications, and variations of these embodiments may be carried out by the skilled person without departing from the scope of the invention. For example, the inventive tool may be shaped and sized so as to assist in the alignment of any number of pin headers, should this be desired. In addition, it is envisaged that the tool could be used to assist in the alignment of other electrical components prior to soldering.

The invention claimed is:

1. A method of assisting alignment of a pin header prior to soldering, the pin header comprising pins supported by a collar, the method comprising:

placing the pin header on a printed circuit board (PCB) such that the pins on a first side of the collar engage the surface of the PCB, and such that the collar contacts the surface of the PCB; and positioning in contact with the pins on the first side of the collar a removable tool so as to exert a force on the pins on the first side of the collar, thereby causing the collar to urge the pins on a second side of the collar into a soldering position.

2. The method of claim 1, wherein the pin header is a right-angled pin header.

3. The method of claim 1, wherein the positioning step comprises removably positioning the tool in contact with the pins of multiple pin headers placed on the PCB, thereby assisting alignment of the multiple pin headers simultaneously.

4. The method of claim 1, wherein the tool comprises a supporting element removably engageable with the PCB, and wherein the method further comprises engaging the supporting element with the PCB.

5. The method of claim 4, wherein the tool comprises a biasing portion joined to the supporting element, and wherein positioning step comprises removably positioning the biasing portion in contact with the pins of the pin header.

6. The method of claim 3, wherein the supporting element is arranged to stabilise the tool when the tool is positioned in contact with the pins of the pin header.

7. The method of claim 3, wherein the supporting element comprises members for engaging with corresponding apertures in the PCB.

8. The method of claim 1, wherein the collar contacts the surface of the PCB at a fulcrum point, and wherein the positioning step comprises removably positioning the tool in contact with the pins on the first side of the collar, thereby urging the pins on the second side of the collar into the soldering position by causing the collar to rotate about the fulcrum point.

9. The method of claim 1, wherein the tool comprises one or more recessed portions, and wherein the method further comprises receiving the collar of the pin header in a recessed portion during positioning of the tool.

10. The method of claim 9, wherein the one or more recessed portions are each sized such that, when receiving the collar of the pin header, a clearance is maintained between the collar and the tool.

11. The method of claim 1, wherein the tool is weighted so as to prevent the pins on the second side of the collar from tending away from the soldering position when the tool is positioned in contact with the pins on the first side of the collar, by exerting an axial force along the pins on the first side of the collar and in a direction of the PCB.

12. The method of claim 1, wherein the centre of gravity of the pin header causes the pins on the second side of the collar to tend away from the soldering position, and wherein the centre of gravity of the tool counterbalances the centre of gravity of the pin header during the positioning step, thereby preventing the pins on the second side of the collar from tending away from the soldering position.

13. The method of claim 1, wherein in the soldering position the pins on the second side of the collar are substantially parallel to the surface of the PCB.

14. The method of claim 1, wherein the positioning step comprises positioning the tool using a pick-and-place machine.

* * * * *